US007051775B2

(12) United States Patent
Hilton et al.

(10) Patent No.: US 7,051,775 B2
(45) Date of Patent: May 30, 2006

(54) SYSTEMS, METHODS AND STRUCTURE TO CAPTURE, STORE AND EVAPORATE SPLIT FLUID

(75) Inventors: Brian S. Hilton, Rochester, NY (US); Kazuyuki Oda, Toda (JP); Takatoshi Tsuchiya, Fujisawa (JP); Eric A. Merz, Palmyra, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 283 days.

(21) Appl. No.: 10/751,516

(22) Filed: Jan. 6, 2004

(65) Prior Publication Data

US 2005/0146570 A1 Jul. 7, 2005

(51) Int. Cl.
*B67C 3/00* (2006.01)
*B41J 2/175* (2006.01)

(52) U.S. Cl. ..... 141/330; 347/85

(58) Field of Classification Search ..... 347/84, 347/85; 141/2, 18, 319, 330, 363, 365, 366
See application file for complete search history.

(56) References Cited

U.S. PATENT DOCUMENTS

| | | | | |
|---|---|---|---|---|
| 5,479,968 | A * | 1/1996 | Sanchez et al. | 141/110 |
| 5,531,055 | A * | 7/1996 | Sell et al. | 53/86 |
| 6,053,603 | A * | 4/2000 | Ito | 347/85 |
| 6,135,590 | A * | 10/2000 | Saeki et al. | 347/86 |
| 6,572,214 | B1 * | 6/2003 | Otis et al. | 347/23 |

FOREIGN PATENT DOCUMENTS

JP 409104118 A * 4/1997

* cited by examiner

*Primary Examiner*—Anh T. N. Vo
(74) *Attorney, Agent, or Firm*—Oliff & Berridge, PLC

(57) ABSTRACT

A refill junction for a fluid container including an exterior surface; a retaining clip having an outer face and an inner face, at least one of the exterior surface and the inner face including at least one capillary.

20 Claims, 4 Drawing Sheets

SYSTEMS, METHODS AND STRUCTURE TO CAPTURE, STORE AND EVAPORATE SPLIT FLUID

BACKGROUND OF THE INVENTION

1. Field of Invention

This invention relates to capturing fluid spilled during refill of a fluid ejection head.

2. Description of Related Art

Fluid ejector systems, such as drop-on-demand liquid ink printers, have at least one fluid ejector from which droplets of fluid are ejected towards a receiving sheet. For example, scanning inkjet printers are equipped with printheads containing fluid ink. The fluid is applied to a sheet in an arrangement based on print data received from a computer, a scanner or similar device. To control the delivery of the fluid to the sheet, fluid ejection heads are moved across the sheet to provide the fluid to the sheet, which is ejected as drops. Each drop corresponds to a liquid volume designated as a pixel. Each pixel is related to a quantity needed to darken or cover a particular unit area.

In order to lower cost and improve performance by limiting inertia, moving-head fluid ejection systems are designed with low-weight fluid ejection heads. In order to minimize weight, the fluid ejection heads contain a relatively small quantity of fluid. Consequently, the fluid injection heads (or their fluid reservoirs) must either be periodically replaced or refilled. Refillable cartridges are commonly used in home-use printers. Some heavier-use printers in industry attach the fluid ejector via an umbilical tube to a larger tank for continuous refilling. Other heavier-use printers periodically refill the fluid ejection head.

Replacing cartridges requires frequent interaction by the user, and is considered disadvantageous for fluid ejectors used in volume production or connected by a network to the ejection data source. Umbilical systems can be expensive, requiring pressurization, tubing, tube harness dressing, and can suffer performance degradation from moisture loss, pressure fluctuations due to acceleration or temperature variation, and motion hysterisis from tubing harness drag.

Periodic refill systems also require interaction by the user. Using a periodic refill system requires one or more refill ports. These ports tend to leak when they are engaged or disengaged. This can result in contamination the fluid ejection medium or even result in fluid coming into contact with the user.

Accordingly, containers for consumable fluids in various applications of fluid ejection may require capturing the leaked fluid. Such applications include, but are not limited to, ink-jet printers, fuel cells, dispensing medication, pharmaceuticals, photo results and the like onto a receiving medium, injecting reducing agents into engine exhaust to control emissions, draining condensation during refrigeration, etc.

SUMMARY OF THE INVENTION

This invention provides systems, methods and structures for capturing fluid spilled when a fluid refill operation is performed on a fluid ejector.

This invention provides systems, methods and structure for storing spilled fluid that has been captured during a fluid refill operation.

This invention provides systems, methods and structure for disposing of spilled fluid that has been captured and stored during a fluid refill operation.

This invention provides systems, methods and structure for preventing the spilling of fluid during a fluid refill operation.

In various exemplary embodiments, a refill system for a fluid reservoir includes a venting port and a fluid inlet port located at a fluid ejection head refill junction. The fluid ejection head refill junction is typically covered by a retaining clip. Typically the top port is the venting port and the bottom port is the fluid inlet port. Fluid is either pushed into the bottom port under pressure or a vacuum is applied to the top port to draw the fluid in through the bottom port. The fluid is introduced through a needle or tubing which engages the port. In various exemplary embodiments, capturing spilled fluid includes providing capillaries in the regions where spilled fluid accumulates. The spilled fluid is transported away from a face of the retaining clip to a reservoir.

In various exemplary embodiments, the fluid is held in the reservoir by a fluid absorbing medium so that it is retained until it can be disposed of.

In various exemplary embodiments, the reservoir is provided with vents which open on the face of the retaining clip to promote evaporation of the fluid. Evaporation of the fluid is further promoted by the motion of the fluid reservoir resulting in the passage of air across the vents.

In various exemplary embodiments, the fluid inlet port and venting port are sealed by a ball valve seal to prevent fluid from spilling.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the devices, systems and methods of this invention will be described in detail with reference to the following figures, wherein.

DETAILED DESCRIPTION OF EXEMPLARY EMBODIMENTS

The following detailed description of various exemplary embodiments of the fluid ejection systems according to this invention may refer to one specific type of fluid ejection system, e.g., an inkjet printer, for sake of clarity and familiarity. However, it should be appreciated that the principles of this invention, as outlined and/or discussed below, can be equally applied to any know or later-developed fluid ejection systems, beyond the fluid jet printer specifically discussed herein.

A fluid ejector 100, such as, for example, an inkjet printhead, is produced, distributed and/or installed with a fluid reservoir, such as, for example, an ink reservoir, typically filled with a fluid, such as, for example, ink. The fluid ejector, includes, in accordance with this invention, a retaining clip 111 which is secured in place on a portion of the reservoir 110 to cover the fluid refill junction 102. The retaining clip 111 is described in detailed below.

Figure 1:
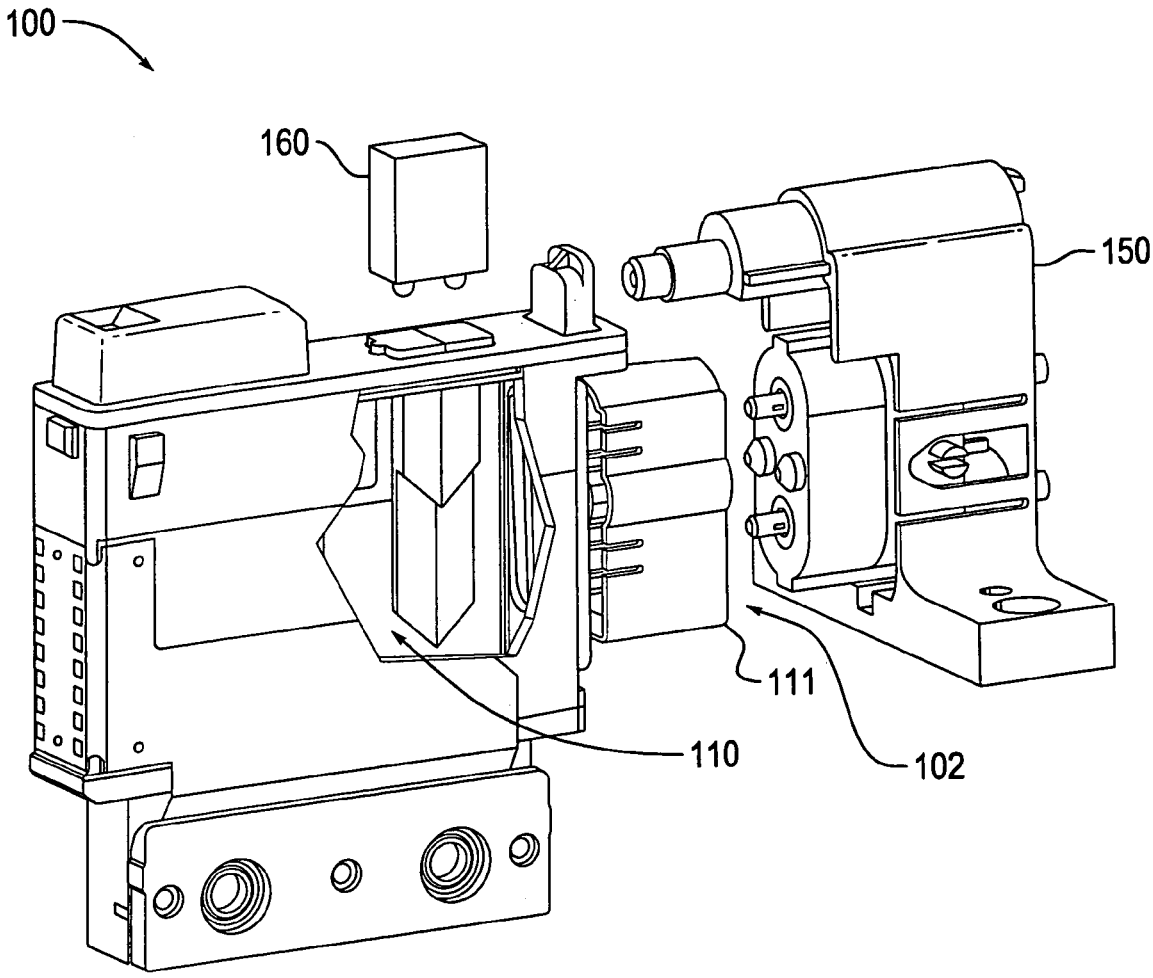
FIG. 1 is an isometric view of an exemplary embodiment of a fluid refill system usable with the systems, methods and structures of the invention.

FIG. 1 shows a fluid ejection head 100 usable with a fluid refill system according to the systems, methods and structures of this invention. As shown in FIG. 1, the fluid ejection head 100 includes the refillable fluid container or reservoir 110 with refill junction 102. The fluid reservoir 110 of the fluid ejection head 100 can be connected to a refill station 150 when a detector 160 detects, for example, that the fluid level in the fluid reservoir 110 has fallen below a predetermined level. Subsequently, the fluid reservoir 110 of the fluid ejection head 100 can be disconnected from the refill station 150 when the detector detects that the level in the fluid reservoir 110 has risen to, for example, a position above the predetermined level.

Figure 2:
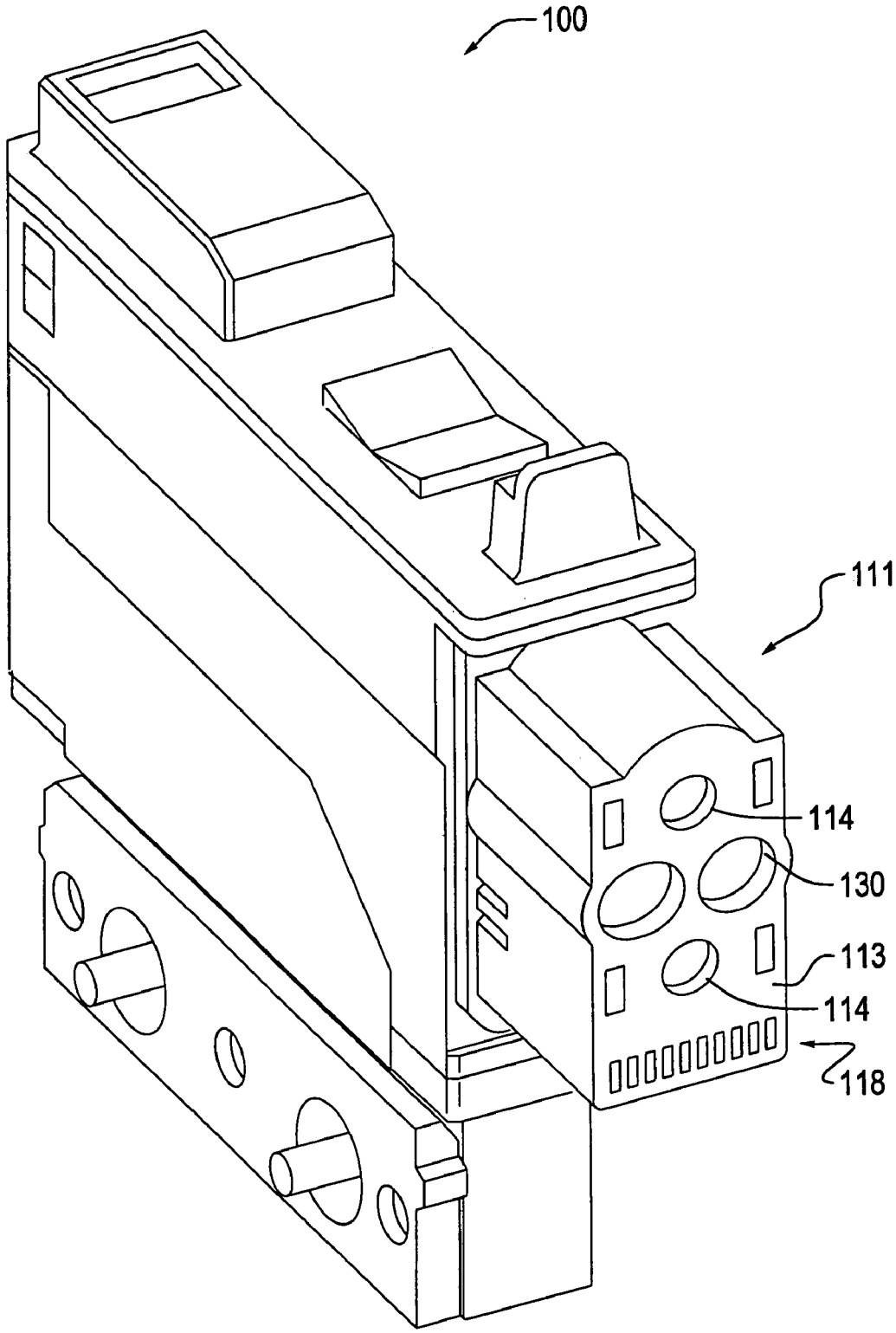
FIG. 2 is a view of an exemplary embodiment of a fluid ejection head having a refillable fluid reservoir.

As shown in FIG. 2, in various exemplary embodiments, the retaining clip 111 serves to cover the refill junction 102 between the reservoir 110 and the refill station 150. FIG. 2 shows the front face 113 of the retaining clip. An air inlet port and an ink inlet port are collectively shown as refill ports 114. Each refill port 114 has a respective injection tube or needle on refill station 150 and is aligned thereto.

When the reservoir 110 is low on fluid, the printhead 100 is transported to the refill station 150. The refill ports 114 are then positioned to be aligned with the refill station needles or tubing and are engaged thereto. Each refill port 114 is provided with a valve which is normally closed to provide a seal. When the refill station needles or tubes engage the refill ports, the valves are opened. In various exemplary embodiments, one of the needles or tubes applies a pressure less than atmospheric, decreasing the pressure within the reservoir 110 and draining fluid from the second needle or tube that is connected to the fluid supply. In other exemplary embodiments, one of the needles or tubes is connected to a pressurized source of fluid which fills the reservoir 110 through one refill port while the second refill port is vented to atmospheric pressure.

During this process, fluid may pool on the outside surfaces of the printhead resulting in staining, poor print quality and user contamination.

Figure 3:
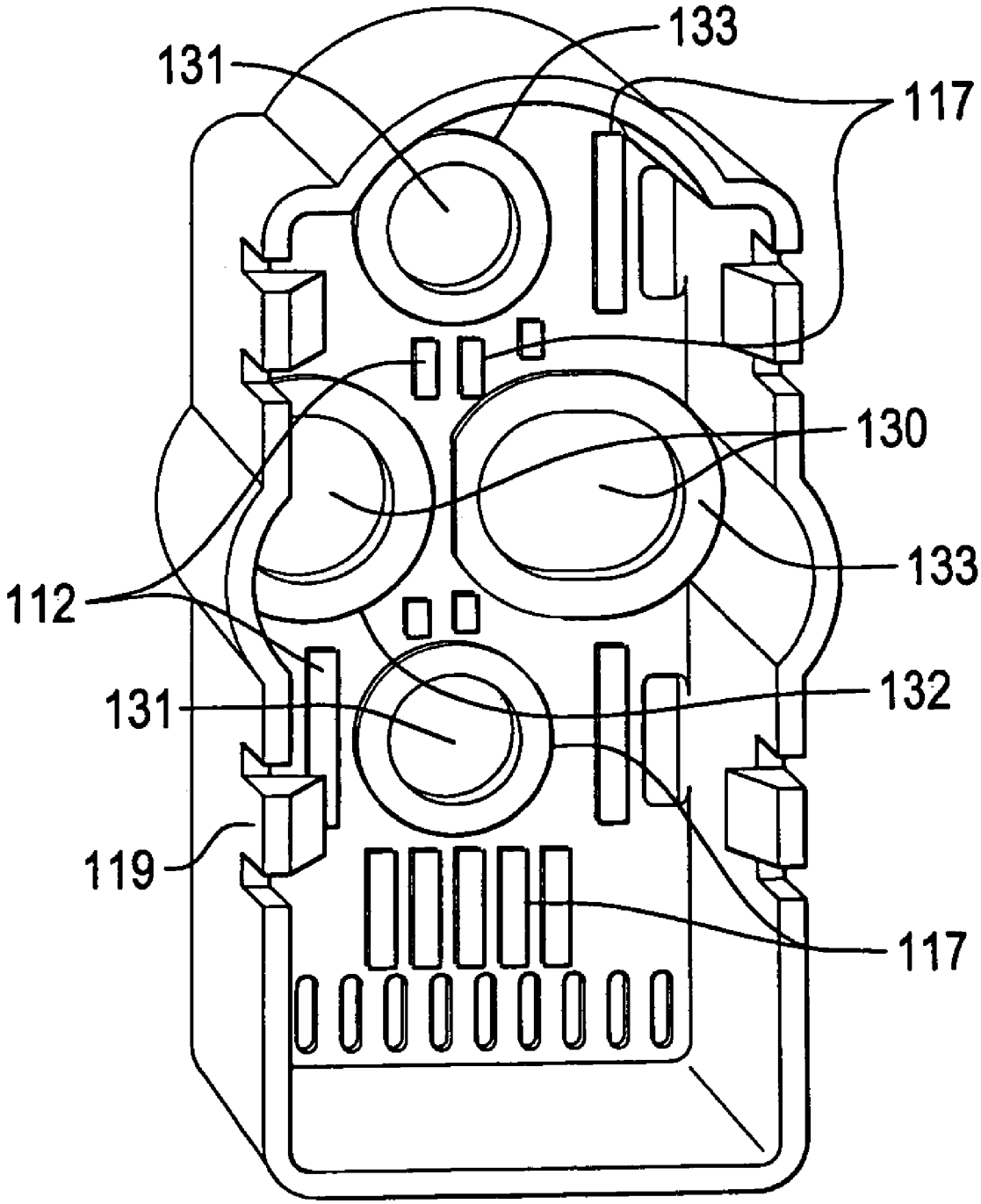
FIG. 3 is a rear view of a retaining clip according to an exemplary embodiment of this invention.

FIG. 3 is a rear view of a retaining clip 111 according to an exemplary embodiment of the invention. As shown in FIG. 3, retaining clip 111 includes clips 119 to secure the retaining clip onto printhead 100. Although clips 119 are shown, any suitable known or later-developed systems, methods or structure may be used to secure retaining clip 111 to printhead 100.

Retaining clip 119 also includes rear wall 132. Rear wall 132 has through holes which include alignment holes 130 which are used to align retaining clip 119 when securing it to printhead 100. It should be appreciated that any suitable known or later-developed systems, methods or structure for alignment may be substituted for alignment holes 130. Through holes 131 are also provided for refill ports 114.

Selected portions of rear wall 132 have raised capillary ribs 112. The ribs 112 are located so as to direct spilled fluid away from alignment holes 130 and through holes 131, keeping the fluid away from the face of retaining clip 111. The fluid is then directed via gravity to the bottom portion of retaining clip 111 where it is absorbed by fluid waste pad 116 (see FIG. 4). Fluid waste pad 116 is located in reservoir 109 formed in retaining clip 111.

Retaining clip 111 is also provided with evaporative slits 118 according to one exemplary embodiment. Evaporative slits 118 are located at the lower portion of retaining clip 111 in proximity to fluid waste pad 116 to promote evaporation of the fluid.

According to an exemplary embodiment of the invention, the evaporative slits are located perpendicular to the path of travel of the printhead. When the printhead is in operation, air traveling through evaporative slits 118 further promotes evaporation.

According to other exemplary embodiments of the invention, rear wall 132 may be provided with raised lips 133 which surround or partially surround the alignment holes 130 and refill ports 114. According to one exemplary embodiment, raised lips 133 completely surround alignment holes 130, so fluid runs around alignment holes 130 before running down due to gravity. This further reduces leakage and increases fluid capture.

According to another exemplary embodiment, raised lips 133 partially surround refill port 114, so that fluid runs partially around refill port 114 and then runs down to areas containing capillary ribs 112.

In other exemplary embodiments of the invention, capillary ribs 114 may be replaced with capillary channels.

Figure 4:
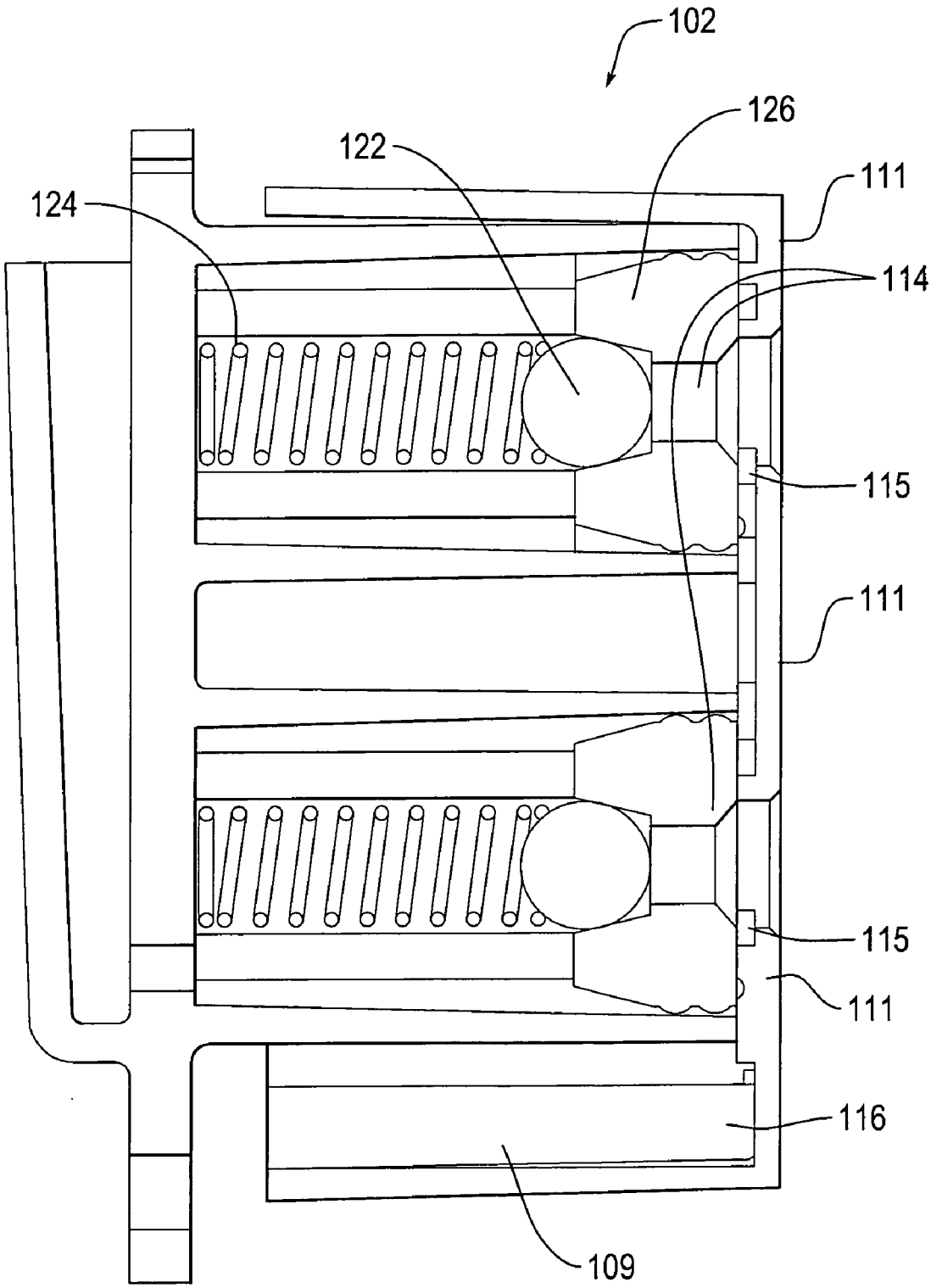
FIG. 4 is a section view of a fluid refill junction according to an exemplary embodiment of this invention.

FIG. 4 shows a section view of a fluid refill junction 102 and fluid refill ports 114. According to an exemplary embodiment of the invention, a ball valve seal 120 is provided at the junction of refill station 150 and reservoir 110. The ball valve seal 120 includes a ball 122 biased by spring 124 to be in contact with seal 126. In one exemplary embodiment, seal 126 is a compliant seal. In other exemplary embodiments, seal 126 can be a septum type seal which is pierced by a needle or has a hole in it to receive a needle or tube from refill station 130 or a combination of a septum type seal with a hole.

When the reservoir is to be refilled, the needle or tube engages the ball 122 to overcome the bias of the spring 124 and separates the ball 122 from the seal 126 to create a passage for fluid or air from the refill station to or from the reservoir 110. When the needle or tube is removed from refill port 114, the ball 122 is again biased by the spring 124 to come into contact with seal 126 to reduce or prevent fluid or air from escaping into or out of the reservoir 110.

Refill junction 102 includes a face 115 which is covered by retaining clip 111. In various exemplary embodiments, the face 115 may include capillary ribs 115 which provide the same function as capillary ribs 112.

While this invention has been described in conjunction with exemplary embodiments outlined above, many alternatives, modifications and variations will be apparent to those skilled in the art. Accordingly, the exemplary embodiments of the invention, as set forth above, are intended to be illustrative, not limiting. Various changes can be made without departing from the spirit and scope of the invention.

What is claimed is:

1. A refill junction between a fluid container and a refill station, comprising:

a retaining clip having a rear wall with an outer side of the rear wall adapted to engage the refill station and having at least one clip extending from the rear wall;

an exterior surface of the fluid container adapted to engage an inner side of the rear wall and the at least one clip; and at least one capillary channel formed on the inner side of the rear wall or on the exterior surface of the fluid container.

2. The refill junction according to claim 1, wherein the at least one capillary channel is formed by at least two capillary ribs.

3. The refill junction according to claim 1, wherein the at least one capillary channel includes at least one groove formed in the inner side of the rear wall or the exterior surface of the fluid container.

4. The refill junction according to claim 1, further comprising:

through holes formed through the rear wall, raised lips formed on the inner side of the rear wall at least partially surrounding the through holes.

5. The refill junction according to claim 1, further comprising:

a reservoir formed in the retaining clip.

6. The refill junction according to claim 5, further comprising:

a fluid waste pad located in the reservoir.

7. The refill junction according to claim 5, further comprising:

at least one evaporation hole formed in the rear wall in the vicinity of the reservoir.

8. A refillable fluid reservoir, comprising:

a refill junction having an exterior surface;

at least one refill port formed in the exterior surface;

a retaining clip adapted to cover the at least one refill port, the retaining clip having through holes to provide access to the at least one refill port; and at least one capillary channel formed on at least one of a rear wall of the retaining clip and the exterior surface of the refill junction.

9. The refillable fluid reservoir according to claim 8, wherein the at least one capillary channel is formed by at least two capillary ribs.

10. The refillable fluid reservoir according to claim 8, wherein the at least one capillary channel includes at least one groove formed in at least one of the rear wall of the retaining clip and the exterior surface of the refill junction.

11. The refillable fluid reservoir according to claim 8, further comprising:

raised lips formed on the rear wall of the retaining clip to at least partially surround the through holes.

12. The refillable fluid reservoir according to claim 8, further comprising:

a fluid waste reservoir formed in the retaining clip.

13. The refillable fluid reservoir according to claim 12, further comprising:

a fluid waste pad located in the fluid waste reservoir; and at least one evaporative hole formed in the retaining clip in the vicinity of the fluid waste pad.

14. The refillable fluid reservoir according to claim 8, the at least one refill port having a ball valve seal.

15. An ink jet printhead comprising the refillable fluid reservoir according to claim 8.

16. A method to capture fluid spilled when refilling a refillable fluid reservoir, the refillable fluid reservoir including at least one refill port from which fluid can be spilled and a retaining clip covering the at least one refill port and having through holes providing access to the at least one refill port, the method comprising the step of:

from a capillary channel formed on the retaining clip wicking spilled fluid by capillary action.

17. The method according to claim 16, further comprising the step of:

collecting the spilled fluid in a fluid waste reservoir.

18. The method according to claim 17, further comprising the step of:

collecting the spilled fluid in a fluid waste pad located in the fluid waste reservoir.

19. The method according to claim 18, further comprising the step of:

evaporating the spilled fluid by moving the refillable fluid reservoir.

20. The method according to claim 16, further comprising the step of:

evaporating the spilled fluid.

* * * * *